US006510877B1

(12) United States Patent
Trajano et al.

(10) Patent No.: US 6,510,877 B1
(45) Date of Patent: Jan. 28, 2003

(54) HAND-HELD CLEANING DEVICE AND A CLEANING SYSTEM

(75) Inventors: Trace Wendell De Guzman Trajano, Manila (PH); Elmer Quirimit Delos Reyes, Baguio (PH)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,781

(22) PCT Filed: Nov. 12, 1999

(86) PCT No.: PCT/US99/26884

§ 371 (c)(1),
(2), (4) Date: Jun. 28, 2001

(87) PCT Pub. No.: WO00/28873

PCT Pub. Date: May 25, 2000

(30) Foreign Application Priority Data

Nov. 18, 1998 (WO) ..... PCT/US98/24576
Nov. 18, 1998 (WO) ..... PCT/US98/24577

(51) Int. Cl.[7] ..... B65B 1/04
(52) U.S. Cl. ..... 141/100; 141/18; 401/47
(58) Field of Search ..... 401/44–47, 196, 401/207, 261, 263, 282, 286, 287; 141/9, 100, 2, 18

(56) References Cited

U.S. PATENT DOCUMENTS

| | | | | |
|---|---|---|---|---|
| 1,610,595 A | * | 12/1926 | Rudolph | 401/184 |
| 1,774,409 A | | 8/1930 | Tripp | |
| 5,114,255 A | | 5/1992 | Villarreal | |
| 5,695,293 A | * | 12/1997 | Chase | 401/283 |
| 5,704,723 A | | 1/1998 | Salisian | |

FOREIGN PATENT DOCUMENTS

| | | |
|---|---|---|
| BE | 647990 | 8/1964 |
| CH | 350085 | 12/1960 |
| WO | WO 99/00049 | 1/1999 |

* cited by examiner

*Primary Examiner*—Steven O. Douglas
(74) *Attorney, Agent, or Firm*—Julia A. Glazer; Kim William Zerby; Steven W. Miller

(57) ABSTRACT

A hand-held cleaning device includes a hollow body member having an interior portion and an exterior portion, the interior portion comprising a plurality of separate reservoirs, an abrasive surface attached to the exterior portion of the hollow body member, and at least one passage leading from each reservoir to the abrasive surface. The present invention also relates to a cleaning system comprising a hand-held cleaning device and a refilling dock.

8 Claims, 6 Drawing Sheets

HAND-HELD CLEANING DEVICE AND A CLEANING SYSTEM

FIELD

The present invention relates to cleaning devices. More specifically, the current invention relates to hand-held cleaning devices for use with a cleaning product.

BACKGROUND

It is known that to adequately clean a substrate, such as a fabric or a hard surface, scrubbing may be required. It is a common habit to add a cleaning product to the substrate and scrub it with, for example, an abrasive surface. Such scrubbing usually entails rubbing or scrubbing a particularly soiled area, such as stains and collars, with a commercially-available pre-treatment product or a bleach product. Scrubbing thus provides improved cleaning by dislodging dirt from the substrate, allowing the cleaning product and/or the solvent to penetrate the substrate, etc.

Devices which are specifically used for cleaning are available, and are typically hand-held. Such hand-held cleaning devices include sponges, brushes, abrasive pads, and other devices. Typically, such hand-held cleaning devices are also intended for scrubbing the substrate. Furthermore, hand-held cleaning devices which contain a cleaning product and simultaneously dispense the product while scrubbing takes place are also known. Such hand-held cleaning devices typically contain a reservoir to hold a cleaning product.

In certain cases for enhanced cleaning, it may be desirable to add an activated cleaning product, for example, an activated bleaching solution, to a substrate and scrub therewith. However, an activated cleaning product may require the commingling of multiple products which are mutually incompatible with respect to activity, stability, etc. For example, an activated bleaching solution having high amounts of active oxygen may require both a bleach precursor product and a liquid bleach activator product; when combined, these two products release active oxygen, which bleaches the substrate. To provide the activated bleaching solution, these two products must be commingled. However, commingling of the products should not occur before the activated product is ready to use, otherwise bleaching effectiveness is typically reduced.

Current hand-held cleaning devices require that the incompatible ingredients of the activated cleaning product be manually commingled, for example, by mixing in a bucket, and then added directly to the substrate. Alternatively, a hand-held cleaning device, such as a brush, may be dipped into the bucket, and then used to scrub the substrate. Such a process is inconvenient and possesses significant disadvantages. For example, the user may have to dip their entire hand in the activated cleaning product. Thus, current hand-held cleaning devices are unsuitable for use with such an activated cleaning product. Additionally, the cleaning effectiveness of such an activated cleaning product is typically greatest immediately upon activation, and decreases over time. Furthermore, typical hand-held cleaning devices do not provide a way to continuously provide such an activated cleaning product.

Refilling the reservoir of such a hand-held cleaning device is also troublesome and inconvenient. Typically, to refill such a hand-held cleaning device requires that the cleaning product be poured into the reservoir. During such a process, the cleaning product may spill, leak, or drip onto the exterior portion of the hand-held cleaning device. This is inconvenient, and thus undesirable.

Accordingly, the need remains for a hand-held cleaning device which is suitable for use with at least two products which commingle so as to form an activated cleaning product. The need also remains for a hand-held cleaning device which continuously forms an activated cleaning product. The need also remains for a hand-held cleaning device which is easily refilled.

SUMMARY

It has now been found that a hand-held cleaning device may contain, in separate reservoirs, at least two products which commingle so as to form an activated cleaning product. It has now also been found that a hand-held cleaning device may continuously form an activated cleaning product. Furthermore, it has now been found that such a hand-held cleaning device may be easily refilled by placing it in an appropriate refilling dock.

The present invention relates to a hand-held cleaning device formed of a hollow body member having an interior portion and an exterior portion. The interior portion of the hollow body member contains a plurality of separate reservoirs, while the exterior portion of the hollow body member contains an abrasive surface. At least one passage leads from each reservoir to the abrasive surface.

The present invention also relates to a cleaning system containing a hand-held cleaning device and a refilling dock. The hand-held cleaning device is formed of a hollow body member having an interior portion and an exterior portion. The interior portion of the hollow body member contains a plurality of separate reservoirs, while the exterior portion of the hollow body member contains an abrasive surface. At least one passage leads from each reservoir to the abrasive surface. Each reservoir is also in connected relation with at least one refilling aperture on the exterior portion of the hollow body member. The refilling dock contains a refilling station and a plurality of tanks, equal in number to the number of reservoirs in the hand-held cleaning device. Each tank is in connected relation with at least one outlet located at the refilling station. The number of outlets is equal in number to the number of refilling apertures on the hand-held cleaning device. When the hand-held cleaning device is removably placed in the refilling station, the outlets on the refilling dock mate with the refilling apertures on the hand-held cleaning device to fill the reservoirs with a product.

These and other features, aspects, and advantages of the present invention will become evident to those skilled in the art from a reading of the present disclosure with the appended claims.

BRIEF DESCRIPTION OF THE DRAWINGS

While the specification concludes with claims particularly pointing out and distinctly claiming the invention, it is believed that the present invention will be better understood from the following description of preferred, nonlimiting embodiments taken in conjunction with the accompanying drawings, in which like numerals identify identical elements and wherein:

DETAILED DESCRIPTION

In accordance with the present invention it has been found that a hand-held cleaning device may provide improved cleaning, be easy to use, and be convenient to refill. Accordingly, the present invention provides a hand-held cleaning device which contains therein a plurality of separate products which when commingled, form an activated cleaning product. Such an activated cleaning product may therefore provide improved cleaning by continuously forming and applying an activated cleaning product before its cleaning effectiveness significantly decreases. Moreover, the design of the invention allows the user to reduce or minimize skin-contact with the detergent product. The hand-held cleaning device of the present invention may be directly used for scrubbing a substrate, and is thus easy to use. The refilling dock as described herein also provides a convenient and tidy manner in which to refill the hand-held cleaning device herein.

The figures herein are not necessarily to scale. All temperatures are in degrees Celsius (° C.) unless otherwise specified. All documents cited are incorporated herein by reference.

As used herein, the term "hand-held" means that the device is of suitable size, shape, and weight, so as to be easily held in a consumer's hand.

Figure 1:
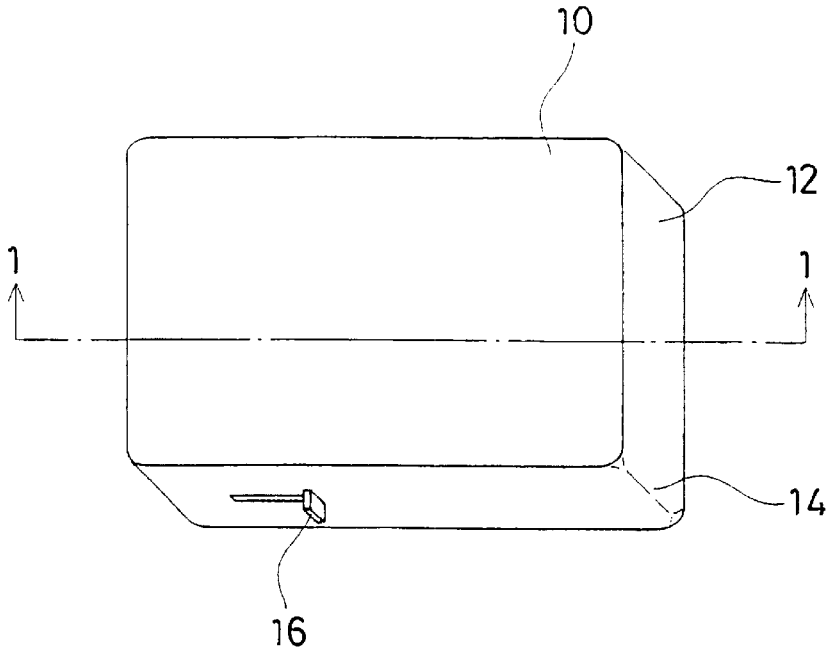
FIG. 1 shows a top perspective view of a hand-held cleaning device of the invention.

Referring to the drawings, FIG. 1 shows a top perspective view of a hand-held cleaning device, 10, of the present invention, having a hollow body member, 12. In order to be convenient and easy to use, the hand-held cleaning device, 10, is of an appropriate size, shape, and weight to be easily held in a consumer's hand. Accordingly, the portion of the hollow body member, 12, where the consumer is expected to grip the hand-held cleaning device, 10, should be from about 4 cm to about 10 cm in width, preferably from about 5 cm to about 9 cm in width, and more preferably from about 5.5 cm to about 8.6 cm in width. While the hollow body member may be of virtually any shape, it is preferable that it possess smooth edges, more preferably rounded edges. Preferred hand-held cleaning device shapes are non-slippery, ergonomic shapes which are easily gripped, for example, rectangular, circular, square, and oval shapes. In locales where laundry bars are common, rectangular shapes may be especially preferred.

The hand-held cleaning device, 10, should be made of materials which are impervious to the product to be contained therein. Suitable materials include, for example, plastics, rubber, wood, metal, glass, and combinations thereof. Preferred materials include, for example, rubber, and plastics such as polyethylene, polypropylene, polyvinyl chloride, acrylonitrile-butadiene styrene, polycarbonate, and polyethylene terephthalate. The hand-held device is preferably rigid, and may be formed via production processes known in the art, such as blow molding, injection molding, injection blow molding, vacuum forming, thermoforming, and combinations thereof.

It is preferred that the hand-held cleaning device, 10, may be easily cleaned, for example, by rinsing it with water or by adding it to the wash cycle of a washing machine. Accordingly, in a preferred embodiment, the hand-held cleaning device is adapted to be placed in the wash cycle of a washing machine; the hand-held cleaning device may therefore be made of a material which withstands alkaline conditions, acidic conditions, washer conditions, dryer conditions, and temperature extremes of at least from about −5° C. to about 120° C. It is also preferred that the hand-held cleaning device not make excessive noise if placed in the wash cycle and/or drying cycle. This may be achieved by, for example, forming the hand-held cleaning device from a soft material.

It is also preferable that the hand-held cleaning device, 10, be of a convenient weight so as to be easily used. Excessively heavy materials and hand-held cleaning devices are to be avoided, as they cause the user to tire quickly, and make cleaning and scrubbing more onerous. Accordingly, in a preferred embodiment, the empty hand-held cleaning device (i.e., without any product contained therein) weighs less than about 500 grams, preferably less than about 300 grams, and more preferably less than about 200 grams.

The hollow body member, 12, contains an interior portion (see FIG. 3 at 22) and an exterior portion, 14. The exterior portion, 14, optionally contains a switch, 16, which controls when the hand-held cleaning device dispenses the products contained therein. Preferably, the switch, 16, is connected to and controls a plurality of valves (see FIG. 3 at 30) inside of the hollow body member, 12. Typically, the switch is conveniently located where it may be easily toggled on and off with the thumb. However, other switch locations and orientations are also useful herein, for example, the switch may be conveniently located in (or on) a handle (not shown), which is in turn located on the exterior portion of the hollow body member. In this embodiment, the thumb can easily toggle the switch while the other fingers hold onto the handle. In a preferred embodiment (see FIGS. 7–11), the switch and valve are toggled by the pressure exerted during scrubbing, such that as scrubbing pressure is increased the amount of product released also proportionally increases.

Figure 2:
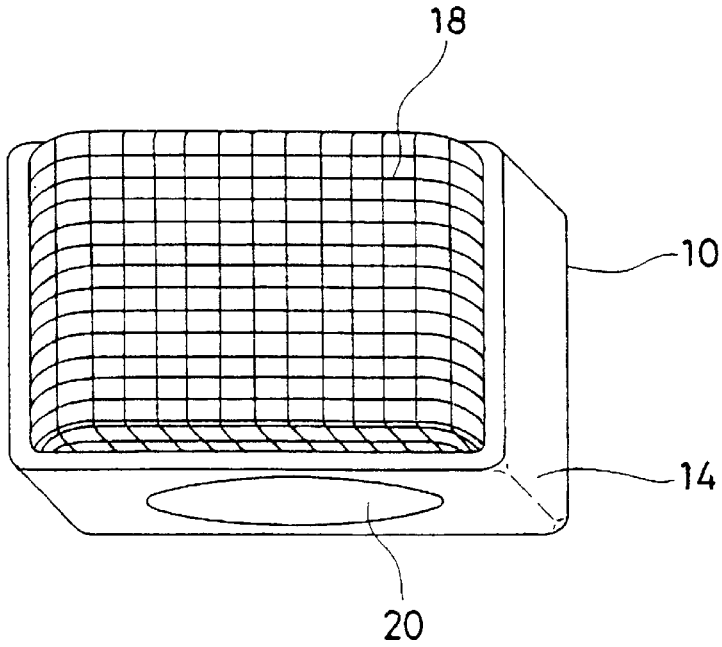
FIG. 2 shows a bottom perspective view of a hand-held cleaning device.

FIG. 2 shows a bottom-perspective view of a hand-held cleaning device, 10, showing the abrasive surface, 18, on the bottom thereof. Cleaning effectiveness is a function of the mechanical force applied to a substrate. When used for scrubbing, the abrasive surface, 18, applies mechanical force to the substrate to increase cleaning performance. However, the physical characteristics of the abrasive surface should be calibrated to the type of substrate it is to be used upon. Thus, the material of the abrasive surface should be such that when used for scrubbing, it does not scratch, tear, or otherwise damage its intended substrate. For example, with a hand-held cleaning device for use on hard surfaces such as tile, a hard, rough surface is useful. In contrast, with a hand-held cleaning device for use on a fabric, such a material is inappropriate; in this case, a smoother, softer, and/or resilient abrasive surface (see FIG. 9 at 58) is useful. Accordingly, the abrasive surface useful herein includes, for example, a sponge, a scrubbing mesh, a fabric, a brush, and combinations thereof. Porous abrasive surfaces such as a sponge, a scrubbing mesh, and combinations thereof are preferred herein. In a laundry or fabric-cleaning operation, a sponge-brush combination is particularly preferred. For hard surfaces, such as tile, ceramics, metal, etc., a sponge contained within a scrubbing mesh is preferred.

As shown in FIG. 2, the exterior portion, 14 of the hand-held cleaning device, 10, may also contain a grip, 20, hereby shown as an ergonomic indentation. The hand-held cleaning device is intended for a cleaning operation employing, for example, water and detergents. In such a cleaning operation, the hand-held cleaning device may become slippery. Accordingly, the present invention preferably has at least one grip on the exterior portion thereof, to allow the user to easily, comfortably, and conveniently scrub and clean with the hand-held cleaning device. Examples of the grip useful herein include ridges, indentations, ergonomic shaping, a handle, and combinations thereof. The grip, 20, and the hand-held cleaning device, 10, may be manufactured separately and combined together, such as for example, when the grip is a rubber or foam sleeve (not shown) which may be affixed to and removed from the hand-held cleaning device, as desired. Alternatively, the grip, 20, may be integral with the exterior portion, 14, as shown in FIG. 2. Such a grip is especially preferred when the device is formed by a process such as blow molding, injection molding, injection blow molding, vacuum forming, thermoforming, etching or engraving, and combinations thereof.

Figure 3:
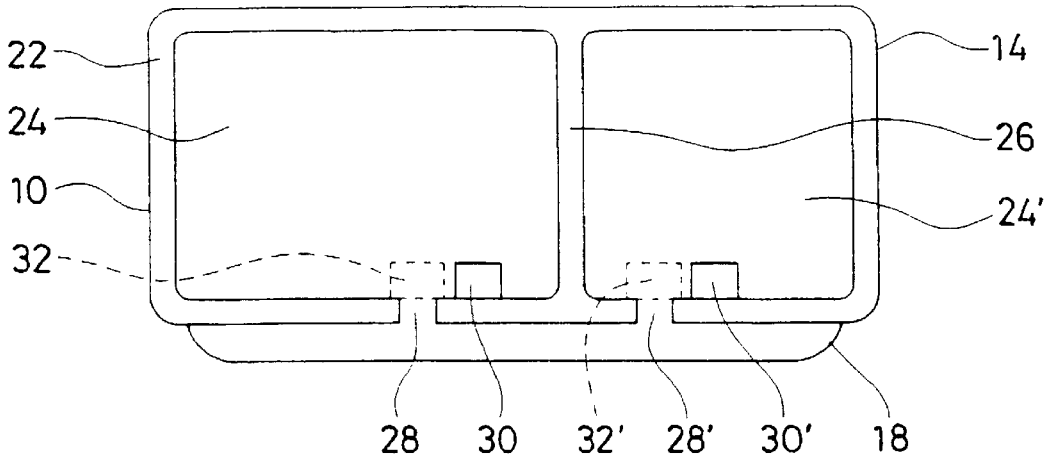
FIG. 3 shows a cross-sectional view of the hand-held cleaning device of FIG. 1 as seen along line 1—1.

FIG. 3 shows a cross-sectional view of the hand-held cleaning device, 10, as seen along line 1—1 in FIG. 1. The exterior portion, 14, is cut away to show the interior portion, 22, which contains a plurality of reservoirs, 24 and 24'. In the figures herein, only two reservoirs, 24 and 24', are depicted for simplicity's sake; however, it should be recognized that the present invention may comprise three, four, or even more reservoirs, as desired. Preferably the plurality of reservoirs contain a plurality of separate products therein, which form an activated cleaning product when commingled. A first reservoir, 24, is separated from a second reservoir, 24', by at least one partition, 26. The partition, 26, substantially prevents the contents of the reservoirs, 24 and 24', from commingling to form the activated cleaning product. Each reservoir, 24 and 24', is connected to the abrasive surface, 18, via at least one passage, 28 and 28', respectively.

Also shown for each reservoir, 24 and 24', is a valve having at least an open position, 30 and 30', and a closed position, 32 and 32', respectively. The switch (FIG. 1, at 16) toggles the valve from the open position, 30 and 30', to the closed position, 32 and 32'. When the valve is in the open position, 30 and 30', the contents of the reservoirs are free to flow into the passage, 28 and 28', and to the abrasive surface, 18. However, when the valve is in the closed position, 32 and 32', the contents of the reservoirs, 24 and 24', are substantially prevented from entering the passage, 28 and 28', and thereby reaching the abrasive surface, 18. This prevents leakage of the products from the reservoirs. Furthermore, this feature allows the hand-held cleaning device to be used for vigorous scrubbing, without further dispensing of the products contained therein.

The valve is represented in FIG. 3 as a valve which has an open position, 30 and 30', and a closed position, 32 and 32'. The preferred valves useful herein include, sliding valves, spring-activated valves, pressure-activated valves, and combinations thereof. Sliding valves provide a sliding portion which may physically block the access to the passage when slid closed by the switch. A spring-activated valve may remain in either the closed, or open position, until toggled by, for example, the switch. Alternatively, a pressure-activated valve may remain in either the open or closed position until pressure is applied to the switch, the abrasive surface, etc. Also useful herein, either in conjunction with, or in place of such valves, are other types of flow control mechanisms, such as membranes through which the product passes, and combinations thereof. In a preferred embodiment, (not shown) the valve comprises a membrane which controls the flow of the products through the passages. For example, a pressure-sensitive membrane may allow the products to flow when pressure is applied to the resilient surface and/or the switch.

In a preferred embodiment, the reservoirs are designed to facilitate product flow, and to prevent waste of the products contained therein. This can be achieved, for example, by designing the reservoir bottoms to channel the product into the passages, or by locating the entrance to the passages at the lowest point of the reservoir. Additionally, the reservoir may be coated with a non-stick material, for example a TEFLON® coating (by DuPont), which facilitates product flow to the passages.

In a preferred embodiment, two reservoirs are present, having a volume ratio of about 1:1 to about 10:1. These two reservoirs are intended for containing two separate products, each possessing a given viscosity. Furthermore, the number of valves and passages leading from the reservoirs are calibrated to these volumes and the viscosities of the intended products, such that the separate products exit the reservoirs at a substantially constant ratio which is about equal to the volume ratio of the two reservoirs. Once the products exit from the reservoirs via the passages, they commingle to form the activated cleaning product. This provides an activated cleaning product which has a constant proportion of the separate products therein, so as to assure an activated cleaning product of consistent quality and performance. This also assures that the reservoirs require refilling at approximately the same time.

In a highly preferred embodiment of the flow control mechanism herein, the switch is connected to a plurality of valves which resemble plugs (see FIGS. 7–11). The valves correspond to at least one passage, such as a dispensing aperture in each reservoir. When the switch is in the open position, the valves allow the product to reach the dispensing apertures. However, when the switch is in the closed position, these valves are also in the closed position, and prevent the product from reaching the dispensing aperture. Each dispensing aperture is further contains a flow control peg therein. The flow control peg has both an open position and a closed position, and is connected to a resilient abrasive surface. Each flow control peg is normally in the closed position; however, when pressure is exerted on the resilient abrasive surface, it displaces the flow control peg into the open position. Thus, when the valves are placed in the open position, the flow control pegs prevent the product from exiting the corresponding dispensing aperture, unless pressure is also applied to the resilient abrasive surface.

The products from the separate reservoirs, 24 and 24', therefore do not mix to form the activated cleaning product, until after they exit their respective reservoirs. Instead, these products typically commingle after passing the valves, preferably immediately prior to, or upon reaching the abrasive surface. This commingling forms an activated cleaning product which may be applied to a substrate. In another embodiment, the activated cleaning product is formed on the substrate itself.

The activated cleaning product is formed by commingling at least two separate products. For example, an active oxygen source may be in a first reservoir, and a bleach activator may be in separate, second reservoir. Thus, in a preferred embodiment, the commingled separate products form an activated cleaning product having a cleaning activity, preferably, a bleaching activity, an enzymatic activity, or mixtures thereof.

Figure 4:
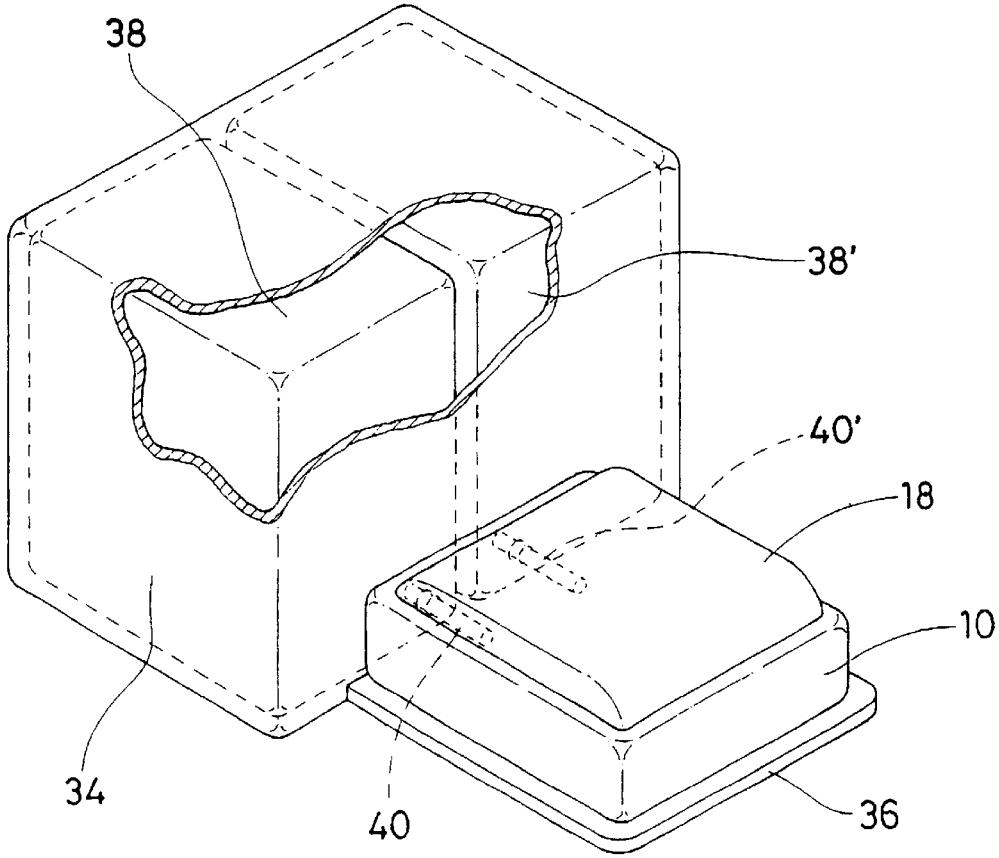
FIG. 4 shows a cut-away, top perspective view of a hand-held cleaning device being refilled by a refilling dock.

In a preferred embodiment, the hand-held cleaning device of the invention is refillable. Accordingly, FIG. 4 shows a cut-away, top perspective view of a refilling dock, 34, which provides easy and convenient refilling of the reservoirs (see FIG. 3, at 24 and 24') within the hand-held cleaning device, 10. As seen, the refilling dock, 34, contains a refilling station, 36, where the hand-held cleaning device, 10, is placed when being refilled. The cut-away portion of the refilling dock, 34, shows a plurality of tanks, 38 and 38', therein. The number of tanks is equal in number to the number of reservoirs within the hand-held cleaning device. Each tank is in connected relation to at least one outlet, 40 and 40', located at the refilling station, 36, through which a product flows, in order to refill the hand-held cleaning device. The number of outlets, 40, is equal in number to the number of refilling apertures (see FIG. 5 at 42), on the hand-held cleaning device, 10.

The tanks, 38, are separate, and prevent the products therein from commingling prior to use, thereby preventing premature formation of the activated cleaning product. The tanks themselves may be either disposable or refillable, for example, via an opening therein (not shown). Optionally, the refilling tanks are made up of translucent or transparent materials, and/or contain a level indicator. This allows the user to easily determine when the tanks require refilling.

As noted above, the tanks, 38, refill the reservoirs with the products, which in turn commingle to form the activated cleaning product. This refilling may be by any means, but typically occurs via gravity-induced refilling, by utilizing pressurized tanks, and combinations thereof. Accordingly, the hand-held cleaning device, 10, may be aligned on the refilling station, 36, in a variety of positions. In FIG. 4, a horizontal position is depicted; however, the actual position may vary, as desired. Thus, vertically-oriented positions, side-oriented positions, etc. are also included within the scope of the present invention. In a preferred embodiment, as shown, the abrasive surface, 18, is facing upward when the hand-held device, 10, is placed in the refilling station, 34.

The refilling dock may be formed of the same material as the hand-held cleaning device, or may be formed of another material. The preferred materials for forming the refilling dock include, plastics, rubber, wood, metal, glass, and combinations thereof. Preferred materials include, for example, rubber, and plastics such as polyethylene, polypropylene, polyvinyl chloride, acrylonitrile-butadiene styrene, polycarbonate, and polyethylene terephthalate. Furthermore, the refilling dock or portions thereof may be formed via production processes known in the art, such as blow molding, injection molding, injection blow molding, vacuum forming, thermoforming, and combinations thereof.

Figure 5:
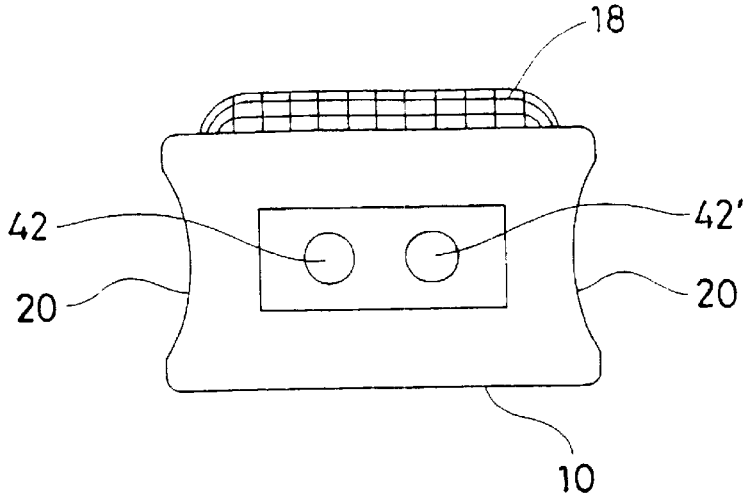
FIG. 5 shows a side view of the hand-held cleaning device and the refilling apertures thereon.

FIG. 5 shows a side view of a hand-held cleaning device, 10, specifically depicting a plurality of refilling apertures, 42 and 42', thereon. When placed in the refilling station (FIG. 4, at 36), the outlets (FIG. 4, at 40 and 40') mate with their respective refilling apertures, 42 and 42', to fill the reservoirs (FIG. 3, at 24 and 24') with a product. Also shown on FIG. 5 is a grip, 20, shown here as an ergonomic indentation, which allows the user to securely hold the hand-held cleaning device, 10, when scrubbing with the abrasive surface, 18.

Figure 6:
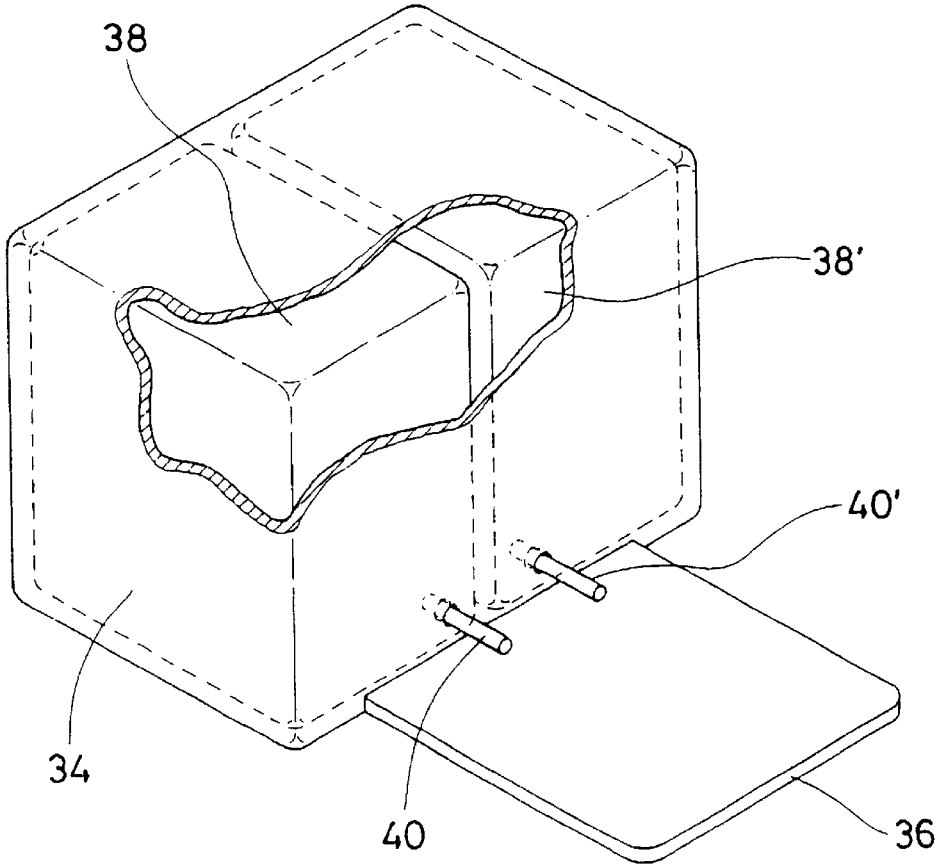
FIG. 6 shows a cut-away, top perspective view of a refilling dock.

FIG. 6 shows a cut-away, top perspective view of a refilling dock, 34, without the hand-held cleaning device. The tanks, 38 and 38' are connected to the outlets, 40, and 40', respectively. During refilling (see FIG. 4), the hand-held cleaning device is removably placed in the refilling station, 36, such that the outlets, 40 and 40', mate with the refilling apertures (see FIG. 5, at 42 and 42'). Each product then flows from its respective tank, 38, through the outlet, 40, and into the reservoir (see FIG. 3, at 24) to refill the hand-held cleaning device.

Figure 7:
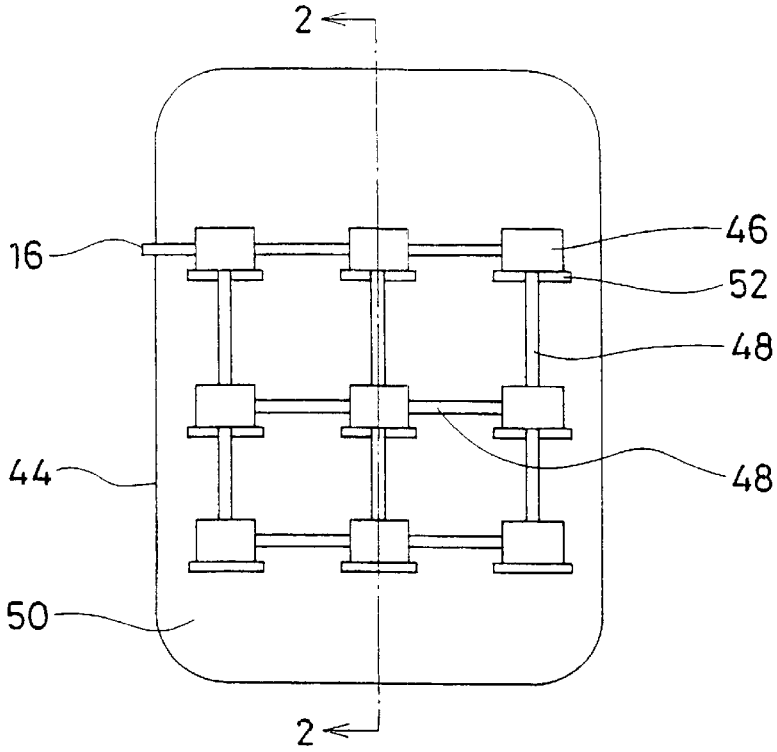
FIG. 7 shows a top view of a flow control mechanism of the invention with the switch in the first position.

FIG. 7 shows a top view of a flow control mechanism, 44, of the present invention. FIG. 7 depicts a switch, 16, in the first position. The switch, 16, is connected to a plurality of plugs, 46, via a support structure, 48. Thus, the switch, 16, either directly or through the support structure, 48, controls the position of the plugs, 46. Also shown in FIG. 7 is reservoir bottom, 50, upon which the plugs, 46, slide back and forth. The reservoir bottom, 50, further contains a plurality of optional bars, 52, which prevent the plurality of plugs, 46, from sliding out of position, and/or past the desired position. Alternatively, the switch, 16, may be designed to prevent the plurality of plugs, 46, from sliding out of position, and/or past the desired position. In a preferred embodiment, at least one bar is present on the reservoir bottom.

Figure 8:
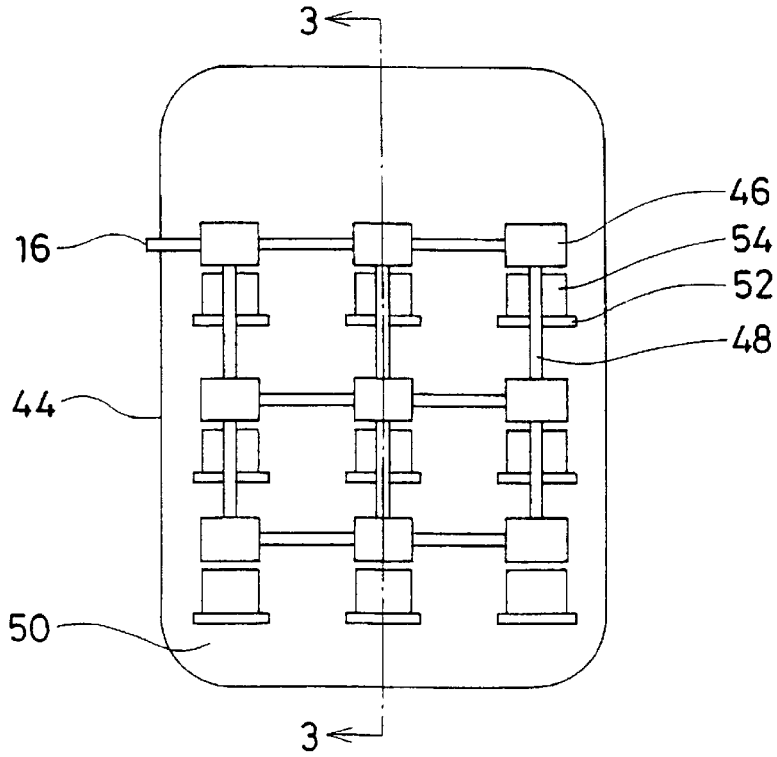
FIG. 8 shows a top view of a flow control mechanism with the switch in the second position.

As seen from FIG. 7 and FIG. 8, respectively, the switch, 16, has a first position, and a second position. When the switch is in the first position, cleaning product from the reservoir (see FIG. 9, at 24) is substantially prevented from entering the dispensing apertures (FIG. 8 at 54), because it is blocked by the plugs. However, when the switch is placed in the second position, the plugs no longer cover the dispensing apertures, and thus, the cleaning product may flow thereto.

The switch, 16, useful herein is depicted in the figures as a simple sliding-type switch, but is not intended to be limited thereto. The switch provides a method for controlling the movement of the plugs, so as to control the cleaning product's flow from the reservoir. Accordingly, the preferred switch useful herein includes a sliding switch, a push-button switch, and combinations thereof. Furthermore, while only one switch is depicted in the figures, it is recognized that multiple switches may also be useful herein. In an alternate embodiment, a single switch may control a flow control mechanism which allows dispensing from multiple reservoirs. It is preferable that the switch is so designed such that it is ergonomically sound and that it will snugly fit the thumb or finger of the user, to allow easy manipulation thereof.

The switch has at least a first position and a second position. However, it is recognized that a sliding switch, for example, may have a virtually unlimited number of positions therein, ranging from fully opened to fully closed. Such switches are preferred for use herein.

At least one plug, preferably a plurality of plugs, 46, is provided herein which controls dispensing of the cleaning product from the reservoir. Each reservoir should have at least one plug. In the figures, the plug, 46, is depicted as a sliding-type plug; however, it is recognized that other types of plugs may also be useful herein. Preferred plugs useful herein include sliding-type plugs, rotating plugs, and combinations thereof. The number of plugs useful herein may be adjusted according to many factors such as the desired flow rate, the size of the dispensing apertures, the viscosity of the cleaning product to be dispensed, etc. However, the present invention typically contains from about 1 to about 100 plugs per reservoir, preferably from about 5 to about 50 plugs per reservoir, more preferably from about 10 to about 20 plugs per reservoir. As the plugs should provide an even distribution of the cleaning product onto the resilient surface (see FIG. 9 at 58), it is preferred that the plugs, 46, and their corresponding dispensing apertures (see FIG. 8 at 54) be approximately evenly distributed across the reservoir bottom, 50.

In addition to connecting the plug, 46, to the switch, 16, the support structure, 48, also maintains the plug in a specific orientation with its respective dispensing aperture (FIG. 8 at 54). As seen in FIG. 7, the support structure also insures that all plugs are slid back and forth at the same time; however, this is optional, as one or more switches and/or support structures may be used herein. The support structure must be designed so as to allow the cleaning product to reach the dispensing aperture when the switch is in the second position (see FIG. 8).

FIG. 8 shows a top view of a flow control mechanism, 44, with the switch, 16, in the second position. Thus, as the switch, 16, is moved into the second position, the plug, 46, is moved to a corresponding position, exposing a dispensing aperture, 54, in the reservoir bottom, 50. Each dispensing aperture, 54, corresponds to a plug, 46. Furthermore, the plug, 46, is at least the same size as, preferably larger than, the dispensing aperture, 54, and located such that when placed in the first position (see FIG. 7 and FIG. 9), the plug substantially prevents the cleaning product from entering the corresponding dispensing aperture, 54.

Accordingly, when the switch, 16, is in the second position, the plug, 46, no longer covers the dispensing aperture, 54. This allows the cleaning product from the reservoir to flow into the dispensing aperture, 54.

Figure 9:
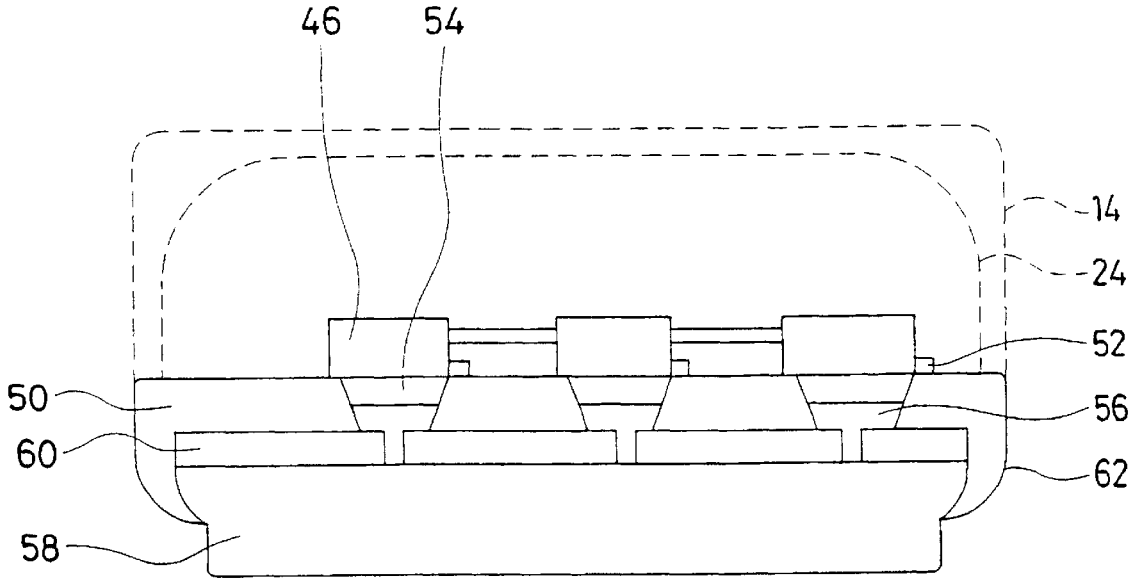
FIG. 9 shows a cross-sectional side view of the flow control mechanism of FIG. 7 as seen along line 2—2.

FIG. 9 shows a cross-sectional side view of the flow control mechanism, 44, of FIG. 7, as seen along line 2—2. Here, dashed line 14 represents the outline of the exterior portion, while dashed line 24 represents the outline of a reservoir containing a cleaning product. It can be seen that the plug, 46, covers the dispensing aperture, 54, to substantially prevent cleaning product from entering the dispensing aperture, 54. FIG. 9 also depicts a plurality of bars, 52, which prevent the plugs from sliding too far.

The dispensing aperture, 54, passes through the entire reservoir bottom, 50. Also seen in FIG. 9 is a flow control peg, 56, corresponding to each dispensing aperture, 54. When in the closed position, as depicted here, the flow control peg, 56, blocks the dispensing aperture, 54, and prevents the cleaning product from flowing through. In a preferred embodiment, as shown here, the dispensing aperture, 54, contains sloped sides. Each flow control peg, 56, also contains matching sloped sides, and thus, fits into the dispensing aperture, 54, but will not pass all the way through the reservoir bottom, 50. Each flow control peg, 56, is attached to the resilient surface, 58.

An optional open area, 60, lies between the reservoir bottom, 50, and the resilient surface, 58. Thus, in this embodiment, when pressure is applied to the resilient surface, 58, it results in two actions. First, the flow control peg, 56, is displaced from the closed position shown in FIG. 9, into the open position shown in FIG. 11. Secondly, the amount of open area, 60, is decreased as the resilient surface, 58, is pushed towards the reservoir bottom, 50. The open area, 60, also allows the displacement of the flow control peg, 56, to be proportional to the pressure applied to the resilient surface, 58. This provides the user with a dispensing method which is convenient, tidy, and intuitive to use. The open area useful herein is from about 2.5 mm to about 30 mm, preferably from about 5 mm to about 20 mm, more preferably from about 7 mm to about 15 mm in height.

The flow control peg, 56, prevents the cleaning product from flowing through the dispensing aperture, 54, unless pressure is applied to the resilient surface, 58. This prevents, for example, excess dispensing of the product which may cause dripping. This also allows the user to only dispense the cleaning product when it is to actually be used. Accordingly, the flow control peg is normally in the closed position, as depicted in FIG. 9. While not required, it is preferred that the flow control peg herein contain sloped sides matching the sloped sides of its respective dispensing aperture.

As is seen in FIG. 9, each flow control peg, 56, is connected to a resilient surface, 58. The resilient surface, 58, either compresses, deforms, or moves when pressure is applied to the bottom thereof. This pressure on the resilient surface, 58, serves to displace the flow control peg, 56, to allow the cleaning product from the reservoir, 24, to flow to the resilient surface, 58. As the cleaning product must still reach the substrate to be cleaned, a porous resilient surface is preferred herein.

In FIG. 9, the resilient surface, 58, is maintained in place by a curved edge, 62, of the reservoir bottom, 50. Other methods for securing the resilient surface, 58, to the reservoir bottom, and/or the flow control pegs are also useful herein. Other preferred securing methods include use of adhesives, heat-sealing or heat-welding, and combinations thereof.

Figure 10:
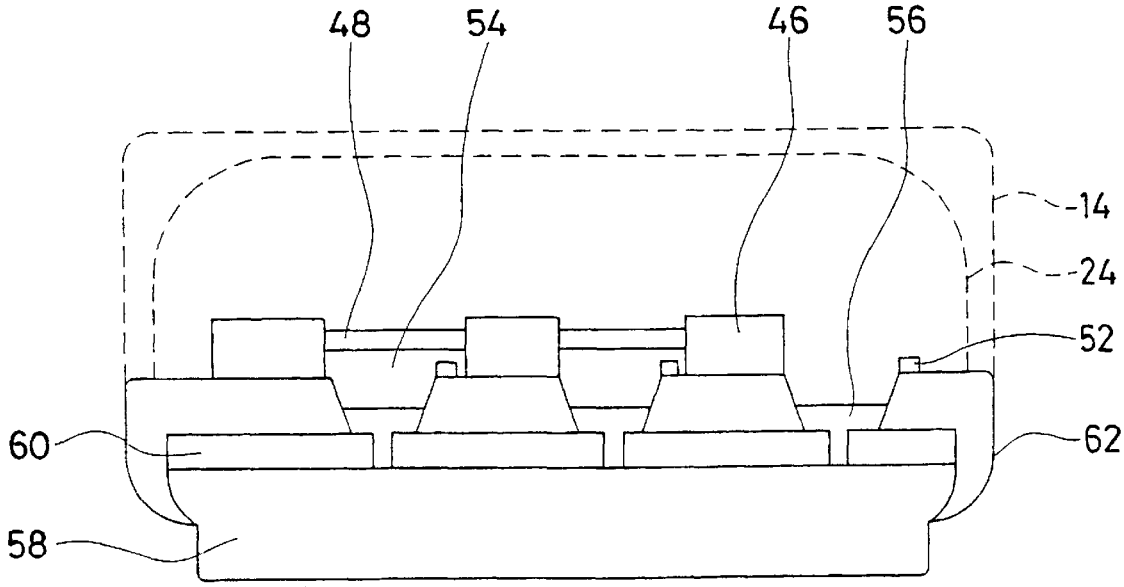
FIG. 10 shows a cross-sectional side view of the flow control mechanism of FIG. 8 as seen along line 3—3.

FIG. 10 shows the a cross-sectional side view of the flow control mechanism, 44, of FIG. 8, as seen along line 3—3. As in FIG. 9, dashed line 14 represents the exterior portion, while dashed line 24 represents the outline of a reservoir containing a cleaning product. In FIG. 10, the plug, 46, no longer covers the dispensing aperture, 54, and thus, the cleaning product from the reservoir, 24, is allowed to flow into the dispensing aperture, 54. However, when pressure is not applied to the resilient surface, 58, the flow control peg, 56, remains in the closed position as shown. Thus, cleaning product from the reservoir, 24, still does not reach the resilient surface, 58. It should be noted that by comparing FIG. 10 and FIG. 8, it is apparent that the support structure, 48, does not significantly prevent the cleaning product from reaching the dispensing aperture.

Figure 11:
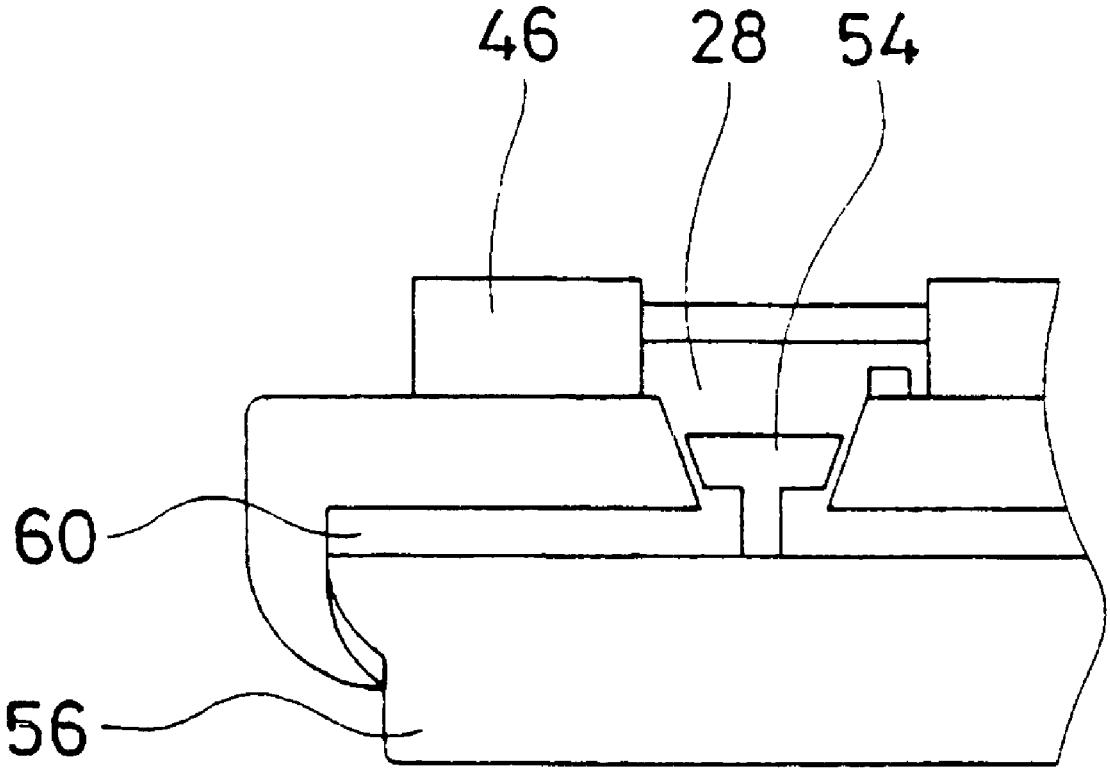
FIG. 11 shows a partial view of FIG. 10, with a flow control peg in the open position.

FIG. 11 shows a partial view of FIG. 10, with the flow control peg, 56, placed into the open position. As pressure is applied to the bottom of the resilient surface, 58, it is pushed upwards, displacing the flow control peg, 56, from its normal, closed position (as seen in FIG. 10), into the open position seen in FIG. 11. As the resilient surface, 58, is pushed upwards, the height of the open area, 60, also decreases. In FIG. 11, the amount of displacement of the flow control peg, 56, is proportional to the amount of pressure applied to the bottom of the resilient surface, 58; the greater the pressure applied to the resilient surface, the greater the displacement of the flow control peg. Thus, FIG. 11 shows that when the plug, 46, is no longer blocking the dispensing aperture, 54, and the flow control peg, 56, is displaced into the open position, cleaning product may enter into the dispensing aperture, 54, flow past the flow control peg, 56, and be delivered to the resilient surface, 58.

Table 1 summarizes the when cleaning product is able to flow from the reservoir to the resilient surface:

TABLE 1

| | Flow control peg = Closed position | Flow control peg = Open position |
|---|---|---|
| Switch = 1st position | No flow | No flow |
| Switch = 2nd position | No flow | Flow possible |

In a preferred embodiment of the present invention, the hand-held cleaning device fits into the refilling station in only a single orientation. This prevents a product from being refilled into the wrong reservoir intended for another product. As the separate products commingle to form an activated cleaning product, it is desirable to prevent inadvertent mixing of the separate products during refilling. This can be provided, for example via a guide (not shown), or a slot (not shown) within which the hand-held cleaning device fits, in only a single orientation.

In a preferred embodiment, a level indicator (not shown) is provided on the hollow body member to indicate whether the hand-held cleaning device requires refilling. Such an indicator includes, for example a transparent window, a mobile indicator, and combinations thereof. The level indicator is typically a type of visual indicator. Additionally, the tanks and/or the refilling dock itself may further contain a level indicator (not shown), which provides an indication of when the tanks are empty. Such an indicator is typically, a visual indicator.

In a preferred embodiment herein, the refilling apertures, the refilling dock, and/or the outlets may contain a mechanism (not shown) which prevents leakage of the product therefrom. It is especially important to prevent leakage when the hand-held cleaning device is not being refilled by the refilling dock. Such a mechanism may contain, for example, a one-way valve, an O-ring, or other mechanisms which would achieve the same purpose. In such an embodiment, a pressure-activated mechanism is preferred. Furthermore, a similar or different mechanism may also prevent the outlets from leaking when the scrubber is not connected to the refilling dock. Alternatively, a one-way rubber gasket or valve may also be useful herein to prevent leakage from the refilling aperture, the outlet, etc. For example, a one-way rubber gasket, as is used in inflatable balls, may be useful herein.

The products which commingle to form the activated cleaning product useful herein comprise at least 2 different products. For example, a bleach precursor product and a bleach activator product which commingle to form an activated cleaning product containing active oxygen. Preferred examples of the products useful herein which may form an activated product include, for example, a bleach activator product and a bleach precursor product, an enzyme product and an enzyme activator product, a bleach product and a surfactant product, etc.

The bleach precursor product useful herein is typically an active oxygen source. While not preferred, herein, hypochlorite or chlorine type bleaches may also be included. The active oxygen source useful herein includes compounds which form available peroxyacid oxygen when exposed to a bleach activator, an alkalinity source, and moisture. An active oxygen source can be hydrophilic, hydrophobic, or both. The active oxygen source useful in the present invention can be any of the oxidizing agents known for laundry, hard surface cleaning, automatic dishwashing, or denture cleaning purposes, including oxygen. A preferred active oxygen source of the peroxygen type includes hydrogen peroxide, inorganic per-compounds, inorganic peroxohydrates, organic peroxohydrates, and mixtures thereof; a more preferred active oxygen source includes hydrogen peroxide, perborate, percarbonate, and mixtures thereof.

Also useful herein as an active oxygen source are the inorganic peroxides such as $Na_2O_2$, superoxides such as $KO_2$, organic hydroperoxides such as cumene hydroperoxide and t-butyl hydroperoxide, and the inorganic peroxoacids and their salts such as the peroxosulfuric acid salts, especially the potassium salts of peroxodisulfuric acid and mixtures thereof; more preferably, of peroxomonosulfuric acid including the commercial triple-salt form sold as OXONE™ by DuPont and also any equivalent commercially available forms such as CUROX™ from Akzo or CAROAT™ from Degussa. Certain organic peroxides, such as dibenzoyl peroxide, may be useful, especially as additives rather than as a primary active oxygen source. A preferred active oxygen source, as noted, includes peroxohydrates, sometimes known as peroxyhydrates or peroxohydrates. These are organic or, more commonly, inorganic salts capable of releasing hydrogen peroxide readily. They include types in which hydrogen peroxide is present as a true crystal hydrate, and types in which hydrogen peroxide is incorporated covalently and is released chemically, for example by hydrolysis. Typically, peroxohydrates deliver hydrogen peroxide readily enough that it can be extracted in measurable amounts into the ether phase of an ether/water mixture. Peroxohydrates are characterized in that they fail to give the Riesenfeld reaction, in contrast to certain other active oxygen sources. Peroxohydrates are the most common examples of "hydrogen peroxide source" materials and include the perborates, percarbonates, perphosphates, and persilicates.

Other materials which serve to produce or release hydrogen peroxide are, of course, useful. Mixtures of two or more peroxohydrates can be used, for example when it is desired to exploit differential solubility. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein. Percarbonate bleach includes, for example, dry particles having an average particle size in the range from about 500 micrometers to about 1,000 micrometers, not more than about 10% by weight of said particles being smaller than about 200 micrometers nd not more than about 10% by weight of said particles being larger than about 1,250 micrometers. These percarbonates are compatible with non-aqueous solvents. Percarbonates and perborates are widely available in commerce, for example from FMC, Solvay and Tokai Denka.

Another suitable hydrogen peroxide generating system is a combination of a $C_1$–$C_4$ alkanol oxidase and a $C_1$–$C_4$ alkanol, especially a combination of methanol oxidase and ethanol (the corresponding bleach activators). Such combinations are disclosed in WO 94/03003 to Labounty, et al., published Feb. 3, 1994. Other enzymatic materials related to bleaching, such as peroxidases, haloperoxidases, oxidases, superoxide dismutases, catalases and their enhancers or, more commonly, inhibitors, may be used as optional ingredients in the instant compositions.

The active oxygen source herein can have any physical form compatible with the intended application; more particularly, liquid-forms, paste-forms, and solid-forms. Liquids can be included in solid detergents, for example by adsorption onto an inert support; and solids can be included in liquid detergents, for example by use of compatible suspending agents. An active oxygen source will typically be at a level of from about 1% to about 30%, more typically from about 5% to about 20%, of the cleaning composition, especially for fabric laundering.

When commingled with the active oxygen source, the bleach activator product leads to production of available peroxyacid oxygen. A bleach activator may comprise an alkalinity source, either alone, or in conjunction with amides, imides, esters, anhydrides, and mixtures thereof. Usually, at least one substituted or unsubstituted acyl moiety is present, covalently connected to a leaving group as in the structure R—C(O)—L. The atom in the leaving group connecting to the peracid-forming acyl moiety R(C)O— is most typically O or N. A bleach activator can have non-charged, positively or negatively charged peracid-forming moieties and/or noncharged, positively or negatively charged leaving groups. One or more peracid-forming moieties or leaving-groups can be present. See, for example, U.S. Pat. No. 5,595,967 to Kellett, et al., issued Jan. 21, 1997, U.S. Pat. No. 5,561,235 to Burns, et al., issued Oct. 1, 1996, U.S. Pat. No. 5,560,862 to Burns, et al., issued Oct. 1, 1996 or the bis-(peroxy-carbonic) system of U.S. 5,534,179 to Kellett, et al., issued Jul. 9, 1996. A bleach activator can be substituted with electron-donating or electron-releasing moieties either in the leaving-group or in the peracid-forming moiety or moieties, changing their reactivity and making them more or less suited to particular pH or wash conditions. For example, electron-withdrawing groups such as $NO_2$ improve the efficacy of bleach activators intended for use in mild-pH (e.g., from about 7.5 to about 9.5) wash conditions. The bleach activator can have many physical forms, for example, the bleach activator itself can be hydrous, or an anhydrous solid or liquid in a non-aqueous solvent.

Examples of a cationic bleach activator includes quaternary carbamate-,quaternary carbonate-, quaternary ester-, quaternary amide-, and mixtures thereof, delivering a range of cationic peroxyimidic, peroxycarbonic or peroxycarboxylic acids to the wash. An analogous but non-cationic palette of bleach activators is available when quaternary derivatives are not desired. In more detail, examples of a cationic bleach activator includes the quaternary ammonium-substituted bleach activators of WO 96-06915 to Baillely, et al., published Mar. 7, 1996, U.S. Pat. No. 4,751,015 to Humphreys, et al., issued Jun. 14, 1988 and U.S. Pat. No. 4,397,757 to Bright and Postlethwaite, issued Aug. 9, 1983, EP-B-284292 to Aoyagi, et al., issued Oct. 19, 1994, EP-B-331,229 to Darwent, et al., issued Aug. 18, 1993 and including 2-(N, N,N-trimethyl ammonium) ethyl-4-sulphophenyl carbonate-(SPCC); N-octyl,N,N-dimethyl-N 10-carbophenoxy decyl ammonium chloride-(ODC); 3-(N,N,N-trimethyl ammonium) propyl sodium-4-sulphophenyl carboxylate; and N,N,N-trimethyl ammonium toluyloxy benzene sulfonate. Also useful are cationic nitrites as disclosed in EP-B1-303,520 to Aoyagi, et al., issued Apr. 20, 1994 and in European Patent Specification 458,396 to Oakes, et al., published Nov. 27, 1991 and 464,880 to Adams, et al., issued Dec. 14, 1994. Other nitrile types such as 3,5-dimethoxybenzonitrile and 3,5-dinitrobenzonitrile can also be used.

Other bleach activator disclosures include GB 836,988 to Davies, et al., published Jun. 9, 1960; GB 864,798 to Hampson and McDonnell, published Apr. 6, 1961; GB 907,356 to Maddox, et al., published Oct. 3, 1962; GB 1,003,310 to Chase and Samuels, published Sep. 2, 1965 and GB 1,519,351 to Wellwood, published Jul. 26, 1978; German Patent 3,337,921 to Balzer, et al., published May 2, 1985; EP-B-0185522 to Fong and Kong, issued Nov. 7, 1990; EP-B-0174132 to Divo, issued Dec. 14, 1988; U.S. Pat. No. 1,246,339 to Smit, issued Nov. 13, 1917; U.S. Pat. No. 3,332,882 to Blumbergs, et al., issued Jul. 25, 1967; U.S. Pat. No. 4,128,494 to Schirmann, et al., issued Dec. 5, 1978; U.S. Pat. No. 4,412,934 to Chung and Spadini, issued Nov. 1, 1983 and U.S. Pat. No. 4,675,393 to Coxon, issued Jun. 23, 1987, and the phenol sulfonate ester of alkanoyl aminoacids disclosed in U.S. Pat. No. 5,523,434 to Burns and Simpson, issued Jun. 4, 1996. Suitable bleach activators include any acetylated diamine types, whether hydrophilic or hydrophobic in character.

A preferred class of bleach activator includes the esters, including acyl phenol sulfonates, acyl alkyl phenol sulfonates or acyl oxybenzenesulfonates (OBS leaving-group); the acyl-amides; the quaternary ammonium substituted peroxyacid precursors including the cationic nitrites, and mixtures thereof. A preferred hydrophobic bleach activator includes sodium nonanoyloxybenzene sulfonate (NOBS or SNOBS), substituted amide types described in detail hereinafter, and the bleach activators related to certain imidoperacid bleaches, for example as described in U.S. Pat. No. 5,061,807 to Gethoffer, et al., issued Oct. 29, 1991 and assigned to Hoechst Aktiengesellschaft of Frankfurt, Germany. Japanese Laid-Open Patent Application (Kokai) No. 4-28799 to Yamada, et al., published Jan. 31, 1992 for example describes a bleaching agent and a bleaching cleaning composition comprising an organic peracid precursor described by a general formula and illustrated by compounds which may be summarized more particularly as conforming to the formula:

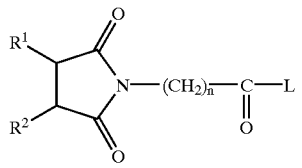

wherein L is sodium p-phenolsulfonate, $R^1$ is $CH_3$ or $C_{12}H_{25}$ and $R^2$ is H. Analogs of these compounds having any of the leaving-groups identified herein and/or having R1 being linear or branched C6–C16 are also useful.

Another bleach activator herein are those derivable from acyclic imidoperoxycarboxylic acids and salts thereof of the formula:

(i)

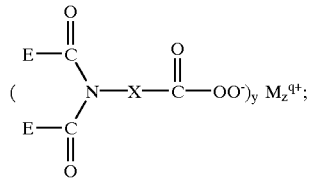

cyclic imidoperoxycarboxylic acids and salts thereof of the formula:

(ii)

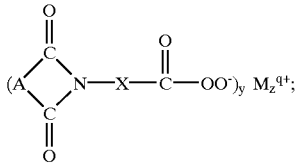

and (iii) mixtures of said compounds, (i) and (ii); wherein M is selected from hydrogen and bleach-compatible cations having charge q; and y and z are integers such that said compound is electrically neutral; E, A and X comprise hydrocarbyl groups; and said terminal hydrocarbyl groups are contained within E and A. The structure of the corresponding bleach activator is obtained by deleting the peroxy moiety and the metal and replacing it with a leaving-group L, which can be any of the leaving-group moieties defined elsewhere herein. In preferred embodiments, in any of said compounds, X is a linear $C_3$–$C_8$ alkyl; A is selected from:

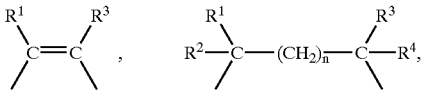

wherein n is from 0 to about 4, and

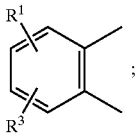

wherein $R^1$ and E are said terminal hydrocarbyl groups, $R^2$, $R^3$ and $R^4$ are independently selected from H, $C_1$–$C_3$ saturated alkyl, and $C_1$–$C_3$ unsaturated alkyl; and wherein said terminal hydrocarbyl groups are alkyl groups comprising at least six carbon atoms, more typically linear or branched alkyl having from about 8 to about 16 carbon atoms.

Another suitable bleach activator includes sodium-4-benzoyloxy benzene sulfonate (SBOBS); sodium-1-methyl-2-benzoyloxy benzene-4-sulphonate; sodium-4-methyl-3-benzoyloxy benzoate; trimethyl ammonium toluyloxybenzene sulfonate; sodium 3,5,5-trimethyl hexanoyloxybenzene sulfonate (STHOBS), and mixtures thereof.

A preferred bleach activator includes N,N,N'N'-tetraacetyl ethylene diamine (TAED) or any of its close relatives including the triacetyl or other unsymmetrical derivatives, and mixtures thereof. TAED and the acetylated carbohydrates such as glucose pentaacetate and tetraacetyl xylose are preferred. Depending on the application, acetyl triethyl citrate, a liquid, also has some utility, as does phenyl benzoate.

A highly preferred bleach activator useful herein is amide-substituted and has either of the formulae:

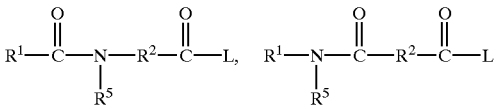

or mixtures thereof, wherein $R^1$ is alkyl, aryl, or alkaryl containing from about 1 to about 14 carbon atoms including both hydrophilic types (short $R^1$) and hydrophobic types (especially when $R^1$ is from about 8 to about 12), $R^2$ is alkylene, arylene or alkarylene containing from about 1 to about 14 carbon atoms, $R^5$ is H, or an alkyl, aryl, or alkaryl containing from about 1 to about 10 carbon atoms, and L is a leaving group. A preferred bleach activator includes those of the formulae, hereinabove, for example the amide-substituted formulae, wherein $R^1$, $R^2$ and $R^5$ are as defined for the corresponding peroxyacid and L is selected from the group consisting of:

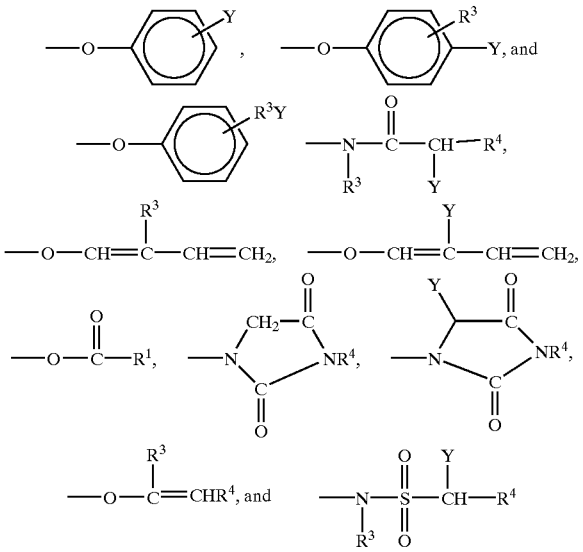

and mixtures thereof, wherein $R^1$ is a linear or branched alkyl, aryl, or alkaryl group containing from about 1 to about 14 carbon atoms, $R^3$ is an alkyl chain containing from 1 to about 8 carbon atoms, R is H or $R^3$, and Y is H or a solubilizing group. These and other known leaving groups are, more generally, suitable alternatives for introduction into any bleach activator herein. Preferred solubilizing groups include —SO3⁻M⁺, —CO2⁻M⁺, —SO4⁻M⁺, —N⁺(R)4X⁻ and O←N(R³)2, more preferably —SO3⁻M⁺ and —CO2⁻M⁺ wherein $R^3$ is and alkyl chain containing from about 1 to about 4 carbon atoms, M is a bleach-stable cation and X is a bleach-stable anion, each of which is selected consistent with maintaining solubility of the bleach activator.

A preferred bleach activator also includes those of the above general formula wherein L is selected from the group consisting of:

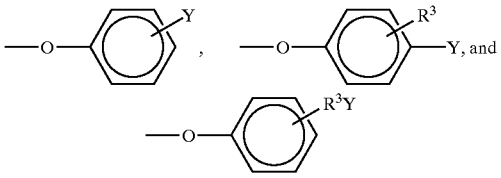

wherein $R^3$ is as defined above and Y is —SO3⁻M⁺ or —CO2⁻M⁺ wherein M is as defined above.

Preferred examples of a bleach activator of the above formulae include (6-octanamidocaproyl) oxybenzenesulfonate, (6-nonanamidocaproyl) oxybenzenesulfonate, (6-decanamidocaproyl) oxybenzenesulfonate, and mixtures thereof. Nonlimiting examples of an additional bleach activator useful herein are to be found in U.S. Pat. No. 4,915,854 to Baker, et al., issued Apr. 10, 1990, U.S. Pat. No. 4,412,934 to Chung and Spadini, issued Nov. 1, 1983 and U.S. Pat. No. 4,634,551 to Hardy and Ingram, issued Jan. 6, 1987. The hydrophobic activator NOBS and the hydrophilic TAED activator are typical, and mixtures thereof can also be used. A preferred bleach activator includes para-acetoxybenzene sulphonate, triacetyl cyanurate, and tetra acetyl glycol uril.

The acyl lactam bleach activators are also very useful herein, especially the acyl caprolactams (see for example WO 94-28102 A to Burns, et al., published Dec. 8, 1994) and acyl valerolactams (see) of the formulae:

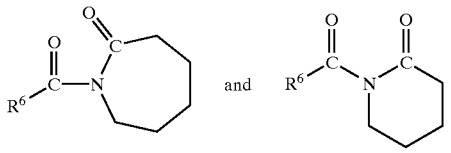

and wherein $R^6$ is H, alkyl aryl, alkoxyaryl, an alkaryl group containing from 1 to about 12 carbon atoms, or substituted phenyl containing from about 6 to about 18 carbons. Also useful are acyl caprolactams, including benzoyl caprolactam adsorbed into sodium perborate. In certain preferred embodiments of the invention, a NOBS, lactam bleach activator, imide bleach activator, or amide-functional bleach activator, especially the more hydrophobic derivatives, are desirably combined with a hydrophilic bleach activator such as TAED, typically at weight ratios of hydrophobic bleach activator:TAED in the range of 1:5 to 5:1, preferably about 1:1. Other suitable examples of a lactam bleach activator are alpha-modified, see WO 96-22350 A1 to Burekett, et al., published Jul. 25, 1996. A lactam bleach activator, especially the more hydrophobic types, are desirably used in combination with TAED, typically at weight ratios of amido-derived or caprolactam bleach activator:TAED in the range of 1:5 to 5:1, preferably about 1:1. See also the bleach activator having a cyclic amidine leaving-group disclosed in U.S. Pat. No. 5,552,556 to Burns, et al., issued Sep. 3, 1996.

An additional bleach activator useful herein include those of U.S. Pat. No. 5,545,349 to Itoh, et al., issued Aug. 13, 1996. Examples include esters of an organic acid and ethylene glycol, diethylene glycol or glycerin, or the acid imide of an organic acid and ethylenediamine; wherein the organic acid is selected from methoxyacetic acid, 2-methoxypropionic acid, p-methoxybenzoic acid, ethoxyacetic acid, 2-ethoxypropionic acid, p-ethoxybenzoic acid, propoxyacetic acid, 2-propoxypropionic acid, p-propoxybenzoic acid, butoxyacetic acid, 2-butoxypropionic acid, p-butoxybenzoic acid, 2-methoxyethoxyacetic acid,2-methoxy-1-methylethoxyacetic acid, 2-methoxy-2-methylethoxyacetic acid,2-ethoxyethoxyacetic acid, 2-(2-ethoxyethoxy) propionic acid, p-(2-ethoxyethoxy)benzoic acid, 2-ethoxy-l-methylethoxyacetic acid, 2-ethoxy-2-methylethoxyacetic acid, 2-propoxyethoxyacetic acid, 2-propoxy-1-methylethoxyaceticacid, 2-propoxy-2-methylethoxyacetic acid, 2-butoxyethoxyacetic acid ,2-butoxy-1-methylethoxyacetic acid, 2-butoxy-2-methylethoxyacetic acid, 2-(2-methoxyethoxy)ethoxyacetic acid, 2-(2-methoxy-1-methylethoxy)ethoxyacetic acid, 2-(2-methoxy-2-methylethoxy)ethoxyacetic acid and 2-(2-ethoxyethoxy) ethoxyacetic acid.

An enzyme product may also be useful herein, either alone, or in combination with an enzyme activator product. Enzymes can be included in the cleaning product for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

An enzyme activator product may also be useful herein. Enzyme products, and especially protease-products are subject to autolysis. However, enzymes typically have their highest activity within a certain pH range. Thus, an enzyme product may have little activity (and thus excellent stability) at, for example, a low pH, but may be highly active at a high pH. Thus, in the present invention, a first reservoir may contain an enzyme in a pH buffer which maintains it at a low, or reduced activity. A second reservoir may contain a corresponding buffer which when commingled, forms a mixture whose pH during use is within the optimal range for the enzyme, and thus, forms an activated enzyme product having an enzymatic activity.

Such pH-buffer activator products are also useful with other types of products, especially bleach products and bleach precursor products. In a preferred embodiment, a bleach precursor product is contained in a first reservoir, while a pH buffer/bleach activator product is contained in a second reservoir. When commingled, the bleach precursor product and the pH buffer/bleach activator product form an activated bleach product, for example, an oxygen bleach having a high available oxygen content.

Alternatively, the present invention may also contain a bleach product and a surfactant product. Certain surfactant components may be incompatible with a bleach, and thus should be separated to enhance long-term stability. Alternatively, when provided in a concentrated form, such products may be incompatible. However, when mixed immediately prior to use, such products may provide enhanced cleaning power. For example, an oxygen bleach may be contained in a first reservoir, while a surfactant product containing an oxidizable chelant is contained in a second reservoir. When the oxygen bleach and the surfactant product containing the oxidizable chelant are mixed, the chelant removes heavy metal ions from solution, while the oxygen bleach bleaches the substrate. A wide variety of other ingredients useful in cleaning products may be included in the compositions herein, including other active ingredients such as surfactants, carriers, hydrotropes, processing aids, suds supressors, suds boosters, dyes, pigments, perfumes, dye transfer inhibitors, optical brighteners, clay soil removal agents, anti-redeposition agents, soil release agents, phosphate and non-phosphate builders, etc. Useful surfactants include those commonly utilized in cleaning products, such as anionic, cationic, nonionic, and amphoteric surfactants.

Examples of the invention are set forth hereinafter by way of illustration and are not intended to be in any way limiting of the invention.

EXAMPLE 1

A hand-held cleaning device of the present invention is prepared, having a transparent, rectangular-shaped hollow body member of approximately 8.6 cm wide by 9.3 cm long, by 3 cm high. The hand-held cleaning device contains two reservoirs therein, the first reservoir containing a bleach precursor product containing an active oxygen source, and the second reservoir containing; a bleach activator and surfactant product. The bleach precursor product contains aqueous hydrogen peroxide solution, while the surfactant product contains an alkalinity source, NOBS, an anionic surfactant, a builder, and an oxidizable chelant.

Dispensing of these products from their respective reservoirs is controlled via a single switch on the exterior portion of the hollow body member. The switch has an open position and a closed position, as described herein. When the switch is in the open position, the products flow from the reservoirs and commingle on the abrasive surface. When commingled, these products form an activated cleaning product having a bleaching and cleaning activity.

The exterior portion of the hollow body member contains two ergonomic grips on opposing sides thereof, to prevent slippage and to allow comfortable scrubbing with the hand-held cleaning device. The abrasive surface contains a resilient sponge surrounded by a nylon scrubbing mesh. The exterior portion also contains two refilling apertures which lead to the reservoirs.

The hand-held cleaning device has a refilling dock at which it may be refilled. The hand-held cleaning device is plugged into the refilling station as seen in FIG. 6, to mate the outlets with their respective refilling apertures. This allows the product to flow from the tanks into the corresponding reservoirs.

What is claimed is:

1. A hand-held cleaning device comprising a hollow body member having an interior portion and an exterior portion, the interior portion comprising a plurality of separate reservoirs, an abrasive surface attached to the exterior portion of the hollow body member, and at least one passage leading from each reservoir to the abrasive surface, wherein the reservoirs contain a plurality of products, wherein the products in the reservoirs exit the reservoirs at a substantially constant ratio, and wherein the products in the reservoirs commingle after exiting the reservoirs to form an activated cleaning product wherein the activated cleaning product has a cleaning activity wherein the cleaning activity is a bleaching activity, an enzymatic activity, or a mixture thereof.

2. The hand-held cleaning device of claim 1, further comprising a switch on the exterior portion of the hollow body member, the switch controlling a plurality of valves in the interior portion of the hollow body member, the valves having an open position and a closed position, wherein when placed in the open position the valves allow a product to flow out of the reservoirs to the abrasive surface, and wherein when placed in the closed position, the valves substantially prevent the product from flowing out of the reservoirs to the abrasive surface.

3. The hand-held cleaning device of claim 1, wherein the activated cleaning product has a cleaning activity selected from the group of a bleaching activity, an enzymatic activity, or mixtures thereof.

4. The hand-held cleaning device of claim 2, wherein the abrasive surface is selected from the group consisting of a sponge, a scrubbing mesh, a fabric, a brush, and combinations thereof.

5. A cleaning system comprising a hand-held cleaning device and a refilling dock, the hand-held cleaning device having a hollow body member having an interior portion and an exterior portion, the interior portion comprising a plurality of separate reservoirs, an abrasive surface attached to the exterior portion of the hollow body member, and at least one passage leading from each reservoir to the abrasive surface, each reservoir being in connected relation with at least one refilling aperture on the exterior portion of the hollow body member, the refilling dock having a refilling station and a plurality of tanks equal in number to the number of reservoirs in the hand-held cleaning device, each tank being in connected relation with at least one outlet located at the refilling station, wherein the number of outlets is equal in number to the number of refilling apertures on the hand-held cleaning device, wherein when the hand-held cleaning device is removably placed in the refilling station, the outlets on the refilling dock mate with the refilling apertures on the hand-held cleaning device to fill the reservoirs with a product.

6. The cleaning system of claim 5, wherein the reservoirs contain a product and wherein the contents of the reservoirs exit the reservoirs at a substantially constant ratio, and wherein the contents of the reservoirs commingle after exiting the reservoirs to form an activated cleaning product.

7. The cleaning system of claim 5, wherein the hand-held cleaning device fits into the refilling station in only a single orientation.

8. A cleaning system comprising a hand-held cleaning device and a refilling dock, the hand-held cleaning device having a hollow body member having an interior portion and an exterior portion, the interior portion comprising at least a first reservoir containing therein a bleach activator product and a second reservoir containing therein a bleach precursor product, an abrasive surface attached to the exterior portion of the hollow body member, and at least one passage leading from each reservoir to the abrasive surface, each reservoir being in connected relation with at least one refilling aperture on the exterior portion of the hollow body member, the refilling dock having a refilling station comprising at least a first tank containing therein a bleach activator product and a second tank containing therein a bleach precursor product, each tank being in connected relation with at least one outlet located at the refilling station, wherein the number of outlets is equal in number to the number of refilling apertures on the hand-held cleaning device, wherein when the hand-held cleaning device is removably placed in the refilling station, the outlets on the refilling dock mate with the refilling apertures on the hand-held cleaning device to fill the first reservoir with a bleach activator product and the second reservoir with a bleach precursor product.

* * * * *